US008975221B2

(12) United States Patent
Kiesel et al.

(10) Patent No.: US 8,975,221 B2
(45) Date of Patent: Mar. 10, 2015

(54) USE OF SUGARS IN A STABILIZATION MATRIX AND SOLID COMPOSITIONS

(75) Inventors: Elizabeth Kiesel, Minneapolis, MN (US); Matthew Zurbey, Cottage Grove, MN (US); Dorothy Williams, St. Paul, MN (US); Michael E. Besse, Golden Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 158 days.

(21) Appl. No.: 12/870,588

(22) Filed: Aug. 27, 2010

(65) Prior Publication Data

US 2012/0053110 A1 Mar. 1, 2012

(51) Int. Cl.

| | |
|---|---|
| ***C11D 11/00*** | (2006.01) |
| ***C11D 17/00*** | (2006.01) |
| ***C11D 3/10*** | (2006.01) |
| ***C11D 3/22*** | (2006.01) |
| ***C11D 7/12*** | (2006.01) |
| ***C11D 7/26*** | (2006.01) |

(52) U.S. Cl.

CPC *C11D 3/221* (2013.01); *C11D 3/10* (2013.01); *C11D 7/12* (2013.01); *C11D 7/268* (2013.01); *C11D 17/0052* (2013.01)

USPC ..... 510/445; 510/444; 510/446; 510/447; 510/439; 510/470; 510/509

(58) Field of Classification Search

USPC ..... 510/444, 445, 446, 447, 439, 470, 509

See application file for complete search history.

(56) References Cited

U.S. PATENT DOCUMENTS

| | | | | | |
|---|---|---|---|---|---|
| 3,852,209 | A | * | 12/1974 | Hofmann | 510/227 |
| 4,102,799 | A | * | 7/1978 | Finck | 510/227 |
| 4,642,197 | A | | 2/1987 | Kruse et al. | |
| RE32,763 | E | * | 10/1988 | Fernholtz et al. | 510/225 |
| 4,888,123 | A | * | 12/1989 | Price et al. | 510/348 |
| 4,908,159 | A | * | 3/1990 | Davies et al. | 510/444 |
| 4,966,606 | A | * | 10/1990 | Garner-Gray et al. | 510/348 |
| 5,152,911 | A | | 10/1992 | Savio | |
| 5,264,144 | A | * | 11/1993 | Moroney et al. | 510/151 |
| 5,279,756 | A | | 1/1994 | Savio | |
| 5,456,903 | A | * | 10/1995 | Huetter et al. | 424/57 |
| 5,545,348 | A | | 8/1996 | Savio | |
| 5,786,320 | A | | 7/1998 | Urfer et al. | |
| 6,017,864 | A | * | 1/2000 | Brittain et al. | 510/218 |
| 6,645,931 | B1 | | 11/2003 | Yanagisawa et al. | |
| 6,811,604 | B2 | | 11/2004 | Mentink et al. | |
| 7,255,731 | B2 | | 8/2007 | Mentink | |
| 7,759,300 | B2 | | 7/2010 | Besse et al. | |
| 8,822,403 | B2 | * | 9/2014 | Olson et al. | 510/445 |
| 2003/0162685 | A1 | * | 8/2003 | Man et al. | 510/445 |
| 2006/0172059 | A1 | | 8/2006 | Takeuchi et al. | |
| 2007/0099807 | A1 | | 5/2007 | Smith et al. | |
| 2009/0176687 | A1 | * | 7/2009 | Tjelta et al. | 510/445 |
| 2010/0311634 | A1 | * | 12/2010 | Besse et al. | 510/224 |
| 2011/0053821 | A1 | * | 3/2011 | Silvernail et al. | 510/299 |

FOREIGN PATENT DOCUMENTS

| | | |
|---|---|---|
| EP | 1138756 | 10/2005 |
| JP | 2002-348594 | 12/2002 |
| WO | WO 02/34870 | 5/2002 |

OTHER PUBLICATIONS

Ramachandran, V.S. *Concrete Admixtures Handbook: properties, science and technology*, 2nd ed. Noyes Publications, NJ. (1995) p. 104.

McCarty, J.A. "Direct Powder Blends for Encapsulation and Tablet Compression Part II: Materials". American Pharmaceutical Review. (2004).

International Search Report and Written Opinion mailed May 29, 2012, PCT/IB2011/053739.

* cited by examiner

*Primary Examiner* — Lorna M Douyon

(74) *Attorney, Agent, or Firm* — Merchant & Gould P.C.

(57) ABSTRACT

The use of sugars in a stabilization matrix and solid detergent compositions is disclosed along with methods of making and using the solid detergent compositions.

9 Claims, No Drawings

USE OF SUGARS IN A STABILIZATION MATRIX AND SOLID COMPOSITIONS

FIELD

The use of sugars in a stabilization matrix and solid detergent compositions is disclosed along with methods of making and using the solid detergent compositions. The matrix and composition have improved stability.

BACKGROUND

Solid detergents are useful in institutional and industrial applications that use large quantities of detergent and have increased soil loads. Various solidification methods and mechanisms have been described. There remains a need for additional solidification technologies.

SUMMARY

The present disclosure relates to a solidification matrix, compositions that include the solidification matrix, and methods of using the compositions. The solidification matrix includes a carbonate, a sugar, and water. Surprisingly, it has been found that sugars help solidify carbonate-based detergents and prevent the solid from swelling. It has also been found that using sugar eliminates the need to use phosphorous-based, or NTA-based materials to prevent swelling in carbonate-based solid blocks.

In an embodiment, the disclosure relates to a solidification matrix that includes at least a sugar, a carbonate, and water where the solidification matrix is a hydrate salt and if heated at a temperature of 120° F., the solidification matrix is dimensionally stable and has a growth exponent of less than 2%.

In another embodiment, the disclosure relates to a solid detergent composition that includes at least a sugar, a carbonate, and water. The composition can also include additional functional materials such as a builder and a surfactant. The solid composition, if heated at a temperature of 120° F., is dimensionally stable and has a growth exponent of less than 2%.

In yet another embodiment, the disclosure relates to a method of solidifying a composition where the method includes mixing a solidification matrix that has at least a sugar, a carbonate, and water, and adding the solidification matrix to a composition for forming a solidified material. If heated at a temperature of 120° F., the composition is dimensionally stable and has a growth exponent of less than about 2%.

DETAILED DESCRIPTION

One solidification mechanism for carbonate-based solid detergents is through hydration, or the interaction between water and the carbonate. Without a method of controlling the hydration, the carbonate can continue to interact with the water, even after it has formed a solid, and shift between hydrate forms (e.g., between one, seven, and ten mole hydrates). Over time this shift leads to swelling. Swelling produces a dimensionally unstable solid block, makes it difficult to package the products, and decreases the density, integrity and appearance of the solid block. It also makes it difficult to dispense evenly. Accordingly, a dimensionally stable solid is important. A solid product is considered to be dimensionally stable if the solid product has a growth exponent of less than about 5%, 4%, 3% or 2%.

Surprisingly, sugars have been found to be an effective method of preventing swelling, and creating a dimensionally stable solid, without having to use phosphorous-based or NTA-based materials. Therefore, the solidification matrix of this disclosure includes at least a carbonate, a sugar, and water.

While not wanting to be bound by theory, sugars are believed to control the kinetics and thermodynamics of the solidification process and provide a solidification matrix where additional functional materials can also be bound to form a functional solid composition. The sugar may stabilize the carbonate hydrate and the functional solid composition by interacting with the free water in the matrix. By controlling the rate of water migration for hydration of the ash, the sugar may control the rate of solidification to provide process and dimensional stability to the resulting product. The rate of solidification is important because if the solidification matrix solidifies too quickly, the composition may solidify during mixing and stop processing. If the solidification matrix solidifies too slowly, valuable process time is lost. The sugar also provides dimensional stability to the end product by ensuring that the solid product does not swell. If the solid product swells after solidification, various problems may occur. Generally, a solid product is considered to have dimensional stability if the solid product has a growth exponent of less than about 5%, 4%, 3%, or 2%.

Prior solidification matrices have used phosphorous-based materials such as phosphates and phosphonates to prevent swelling. But there is a move away from phosphorous-based materials for environmental and regulatory reasons. Nitrilotriacetic acid (NTA) has been used as a phosphorous substitute but is now believed to be carcinogenic. Accordingly, in some embodiments, the solidification matrix and solid composition are free or substantially free of phosphorous, NTA, or both. In some embodiments, the solidification matrix or solid compositions have less than about 10% phosphorous, less than about 5% phosphorous, or less than about 0.5% phosphorous. In some embodiments, the solidification matrix or solid composition have less than about 60% NTA, less than about 20% NTA, or less than about 1% NTA.

In some embodiments, the solidification matrix can consist essentially of a carbonate, a sugar and water. The solidification matrix may contain certain properties to it such as dimensional stability at elevated temperatures. The solidification matrix can also limit phosphorous and/or NTA. If the solidification matrix "consists essentially of" carbonate, sugar, and water, it excludes materials that are not necessary for the solidification process. These excluded materials can include, for example, materials that are classified as additional functional materials.

Carbonate

The solidification matrix and detergent composition include a carbonate. Exemplary carbonates include alkali metal carbonates such as sodium or potassium carbonate, bicarbonate, sesquicarbonate, and mixtures thereof.

The carbonate is preferably present in the solidification matrix from about 50 to about 95 wt. %, from about 60 to about 90 wt. %, and from about 70 to about 90 wt. %. The carbonate is preferably present in the solid composition from about 20 to about 95 wt. %, from about 40 to about 90 wt. %, and from about 60 to about 90 wt. %.

In some embodiments, the solidification matrix can include a ratio of carbonate:water of at least 3.5:20, 4.5:17, or 6:15.

Sugar

The solidification matrix and detergent composition include a sugar. The sugar can be a saccharide such as a monosaccharide or a disaccharide. The sugar can also be a polyfunctional sugar derivative such as a sugar alcohol.

A monosaccharide refers to simple sugars. Examples of monosaccharides include glucose, fructose, galactose, xylose, and ribose. Monosaccharides also include erythrose, threose, arabinose, lyxose, allose, altrose, mannose, gulose, idose, talose, erythrulose, ribulose, xylulose, psicose, sorbose, and tagatose.

A disaccharide refers to a sugar with two monosaccharides. Examples of disaccharides include sucrose, lactulose, lactose, maltose, trehalose, and cellobiose. Disaccharides also include kojibiose, nigerose, isomaltose, sophorose, laminaribiose, gentiobiose, turanose, maltulose, palatinose, gentiobiulose, mannobiose, melibiose, melibiulose, rutinose, rutinulose, and xylobiose.

The sugar can also be a polyfunctional sugar derivative such as a sugar alcohol. Sugar alcohols include glycol, glycerol, erythritol, threitol, arabitol, xylitol, ribitol, mannitol, sorbitol, dulcitol, iditol, isomalt, malitol, polyglycitol, and lacitol.

The sugar can be a single sugar or a combination of sugars. The sugar can be straight-chained or ring structure. And the sugar can be the L- or D-isomer of the sugar.

While not wanting to be bound by theory, it is believed that preferred sugars help the solidification process through hydrogen bonding or a ratio of carbon to oxygen in the sugar. If the sugar molecule is too large, the water cannot get to the oxygen molecules on the sugar molecule and the sugar becomes ineffective at forming a stable solid.

The sugar is preferably present in the solidification matrix in an amount effective to control the kinetics and thermodynamics of the solidification matrix by controlling the rate and movement of water. For example, the sugar may be present in the solidification matrix from about 0.1 to about 20 wt. %, from about 0.5 to about 15 wt. %, and from about 0.5 to about 10 wt. %. The sugar may be present in the solid composition from about 0.05 to about 20 wt. %, from about 0.25 to about 15 wt. %, and from about 0.25 to about 10 wt. %.

In some embodiments, the solidification matrix can include a ratio of sugar:water of at least 0.001:4, 0.01:2, or 0.1:1.

Water

Water may be independently added to the solidification matrix or may be provided in the solidification matrix as a result of its presence in an aqueous material that is added to the detergent composition or matrix. For example, materials added to the detergent composition or matrix may include water or may be prepared in an aqueous premix available for reaction with the solidification matrix components. The water may thus be present in the form of aqueous solutions of the solidification matrix, or aqueous solutions of any of the other ingredients, and/or added aqueous medium. The water may optionally be provided as deionized water or as softened water.

The amount of water in the resulting solid detergent composition will depend on whether the solid detergent composition is processed through forming techniques or casting (solidification occurring within a container) techniques. In general, when the components are processed by forming techniques, it is believed that the solid detergent composition can include a relatively smaller amount of water for solidification compared with the casting techniques. When preparing the solid detergent composition by forming techniques, water may be present in ranges of between about 5 wt. % and about 25 wt. %, about 7 wt. % and about 20 wt. %, and about 8 wt. % and about 15 wt. %. When preparing the solid detergent composition by casting techniques, water may be present in the ranges of between about 15 wt. % and about 50 wt. %, about 20 wt. % and about 45 wt. %, and about 22 wt. % and about 40 wt. %.

Additional Functional Materials

The solidification matrix can be used to form a solid detergent composition including additional functional materials. As such, in some embodiments, the solidification matrix including the sugar, water, and carbonate may provide a large amount, or even all of the total weight of the detergent composition, for example, in embodiments having few or no additional functional materials disposed therein. The additional functional materials provide desired properties and functionalities to the solid detergent composition. For the purpose of this application, the term "functional materials" includes a material that when dispersed or dissolved in a use and/or concentrate solution provides a beneficial property. Some particular examples of functional materials are discussed in more detail below, although the particular materials discussed are given by way of example only, and that a broad variety of other functional materials may be used. For example, many of the functional materials discussed below relate to materials used in cleaning and/or destaining applications. However, other embodiments may include functional materials for use in other applications.

Alkaline Source

The solid detergent composition may optionally include an effective amount of an additional alkaline source to enhance cleaning of a substrate and improve soil removal performance of the solid detergent composition. In general, the composition may include the optional alkaline source in an amount of at least about 5 wt. %, at least about 10 wt. %, or at least about 15 wt. %. In order to provide sufficient room for other components in the concentrate, the alkaline source can be provided in the concentrate in an amount of less than about 75 wt. %, less than about 60 wt. %, less than about 40 wt. %, less than about 30 wt. %, or less than about 20 wt. %. The alkalinity source may constitute between about 0.1 wt. % and about 90 wt. %, between about 0.5 wt. % and about 80 wt. % by weight, and between about 1 wt. % and about 60 wt. % of the total weight of the solid detergent composition.

An effective amount of an additional alkaline source may be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be safer than the caustic based use compositions. In some circumstances, the solid detergent composition may provide a use composition that is useful at pH levels below about 8. In such compositions, the alkaline source may be omitted, and additional pH adjusting agents may be used to provide the use composition with the desired pH.

Examples of suitable additional alkaline sources of the solid detergent composition include, but are not limited to an alkali metal hydroxides, metal silicates, metal borates, and ethanolamines and amines. Such alkalinity agents are commonly available in either aqueous or powdered form, either of which is useful in formulating the present solid detergent compositions. Exemplary alkali metal hydroxides that can be used include, but are not limited to sodium, lithium, or potassium hydroxide. The alkali metal hydroxide may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50% and a 73% by weight solution. It is preferred that the alkali metal hydroxide is added in the form of an aqueous solution, particularly a 50% by weight hydroxide solution, to reduce the amount of heat generated in the composition due to hydration of the solid alkali material. Exemplary metal silicates include, but are not limited to sodium or potassium silicate or metasilicate. Exemplary metal borates include, but are not limited to sodium or potassium borate.

Surfactants

The solid detergent composition may optionally include at least one cleaning agent comprising a surfactant or surfactant system. A variety of surfactants can be used in a solid detergent composition, including, but not limited to: anionic, nonionic, cationic, and zwitterionic surfactants. Exemplary surfactants that can be used are commercially available from a number of sources. For a discussion of surfactants, see Kirk-Othmer, Encyclopedia of Chemical Technology, Third Edition, volume 8, pages 900-912. When the solid detergent composition includes a surfactant, the surfactant is provided in an amount effective to provide a desired level of cleaning. The solid detergent composition, when provided as a concentrate, can include the surfactant in a range of about 0.05 wt. % to about 20 wt. %, about 0.5 wt. % to about 15 wt. %, about 1 wt. % to about 15 wt. %, about 1.5 wt. % to about 10 wt. %, and about 2 wt. % to about 8 wt. %. Additional exemplary ranges of surfactant in a concentrate include about 0.5 wt. % to about 8 wt. %, and about 1 wt. % to about 5 wt. %.

Examples of anionic surfactants useful in the solid detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the solid detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC™, available from BASF Corporation, Florham Park, N.J. An example of a commercially available silicone surfactant includes, but is not limited to, ABIL™ B8852, available from Goldschmidt Chemical Corporation, Hopewell, Va.

Examples of cationic surfactants that can be used in the solid detergent composition include, but are not limited to: amines such as primary, secondary and tertiary monoamines with alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the solid detergent composition include, but are not limited to: betaines, imidazolines, and propionates.

If the solid detergent composition is intended to be used in an automatic dishwashing or warewashing machine, the surfactants selected, if any surfactant is used, can be those that provide an acceptable level of foaming when used inside a dishwashing or warewashing machine. Solid detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Some surfactants can also function as secondary solidifying agents. For example, anionic surfactants which have high melting points provide a solid at the temperature of application. Anionic surfactants which have been found most useful include, but are not limited to: linear alkyl benzene sulfonate surfactants, alcohol sulfates, alcohol ether sulfates, and alpha olefin sulfonates. Generally, linear alkyl benzene sulfonates are preferred for reasons of cost and efficiency. Amphoteric or zwitterionic surfactants are also useful in providing detergency, emulsification, wetting and conditioning properties. Representative amphoteric surfactants include, but are not limited to: N-coco-3-aminopropionic acid and acid salts, N-tallow-3-iminodiproprionate salts, N-lauryl-3-iminodiproprionate disodium salt, N-carboxymethyl-N-cocoalkyl-N-dimethylammonium hydroxide, N-carboxymethyl-N-dimethyl-N-(9-octadecenyl)ammonium hydroxide, (1-carboxyheptadecyl)trimethylammonium hydroxide, (1-carboxyundecyl)trimethylammonium hydroxide, N-cocoamidoethyl-N-hydroxyethylglycine sodium salt, N-hydroxyethyl-N-stearamidoglycine sodium salt, N-hydroxyethyl-N-lauramido-beta-alanine sodium salt, N-cocoamido-N-hydroxyethyl-beta-alanine sodium salt, mixed alcyclic amines and their ethoxylated and sulfated sodium salts, 2-alkyl-1-carboxymethyl-1-hydroxyethyl-2-imidazolinium hydroxide sodium salt or free acid wherein the alkyl group may be nonyl, undecyl, and heptadecyl. Other useful amphoteric surfactants include, but are not limited to: 1,1-bis(carboxymethyl)-2-undecyl-2-imidazolinium hydroxide disodium salt and oleic acid-ethylenediamine condensate, propoxylated and sulfated sodium salt, and amine oxide amphoteric surfactants.

Builders or Water Conditioners

The solid detergent composition may optionally include one or more building agents, also called chelating or sequestering agents (e.g., builders), including, but not limited to: a condensed phosphate, a phosphonate, an aminocarboxylic acid, or a polyacrylate. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1 wt. % to about 70 wt. %, about 1 wt. % to about 60 wt. %, or about 1.5 wt. % to about 50 wt. %. If the solid detergent is provided as a concentrate, the concentrate can include between approximately 1 wt. % to approximately 60 wt. % by weight, between approximately 3 wt. % to approximately 50 wt. %, and between approximately 6 wt. % to approximately 45 wt. % of the builders. Additional ranges of the builders include between approximately 3 wt. % to approximately 20 wt. %, between approximately 6 wt. % to approximately 15 wt. %, between approximately 25 wt. % to approximately 50 wt. %, and between approximately 35 wt. % to approximately 45 wt. %.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration.

Examples of phosphonates included, but are not limited to: 1-hydroxyethane-1,1-dipho sphonic acid, $CH_3C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{28-x}N_3Na_xO_{15}P_5$ (x=7); hexamethylenediamine(tetramethylenephosphonate), potassium salt, $C_{10}H_{28-x}N_2K_xO_{12}P_4$ (x=6); bis(hexamethylene)triamine(pentamethylenephosphonic acid), $(HO_2)POCH_2N[(CH_2)_6N[CH_2P(OH)_2]_2]_2$; and phosphorus acid, $H_3PO_3$. A preferred phosphonate combination is ATMP and DTPMP. A neutralized or alkaline phosphonate, or a combination of the phosphonate with an alkali source before being added into the mixture such that there is little or no heat or gas generated by a neutralization reaction when the phosphonate is added is preferred.

The solid detergent composition preferably contains a non-phosphorus based builder. Although various components may include trace amounts of phosphorous, a composition that is considered free of phosphorous generally does not include phosphate or phosphonate builder or chelating components as an intentionally added component. Carboxylates such as citrate or gluconate are suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The solid detergent compositions may optionally include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid detergent composition during use.

The amount of hardening agent included in the solid detergent composition will vary according to factors including, but not limited to the type of solid detergent composition being prepared, the ingredients of the solid detergent composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the hardening agent included in the solid detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the solid detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of solid detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of about 1,000 to about 100,000, about 1,450 to about 20,000, or about 1,450 to about 8,000. The polyethylene glycol is present at a concentration of from about 1 wt. % to about 75 wt. %, or about 3 wt. % to about 15 wt. %. Suitable polyethylene glycol compounds include, but are not limited to PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50 wt. %, particularly approximately 5 wt. % to approximately 25 wt. %, and more particularly approximately 5 wt. % to approximately 15 wt. %.

Urea particles can also be employed as hardeners in the solid detergent compositions. The solidification rate of the compositions will vary, at least in part, by factors including the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid detergent composition is effective to provide a desired hardness and desired rate of solubility of the composition when placed in an aqueous medium to achieve a desired rate of dispensing the cleaning agent from the solidified composition during use. In some embodiments, the composition includes about 5 wt. % to about 90 wt. % urea, about 8 wt. % to about 40 wt. % urea, or about 10 wt. % to about 30 wt. % urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

The composition may optionally include a bleaching agent. Bleaching agents suitable for use in the solid detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the solid detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. Because of the presence of the sugar in the solidification matrix and the solid composition, if a bleaching agent is present, it is preferably present in form that does not allow for direct contact with the sugar. For example, the bleaching agent can be encapsulated, physically separated for example by packaging or a film, or in different layers or regions of a composition. When the concentrate includes a bleaching agent, it can be included from about 0.1 wt. % to about 60 wt. %, about 1 wt. % to about 20 wt. %, about 3 wt. % to about 8 wt. %, or about 3 wt. % to about 6 wt. %.

Fillers

The solid detergent composition may optionally include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate, sodium chlorides, starches, and sugars. When the concentrate includes a detergent filler, it can be included in an amount up to about 50 wt. %, from about 1 wt. % to about 30 wt. %, or from about 1.5 wt. % to about 25 wt. %.

Defoaming Agents

A defoaming agent for reducing the stability of foam may optionally be included in the solid composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. When the concentrate includes a defoaming agent, the defoaming agent can be provided in an amount from about 0.0001 wt. % to about 10 wt. %, about 0.001 wt. % to about approximately 5 wt. %, or about 0.01 wt. % to about 1.0 wt. %.

Anti-Redeposition Agents

The solid detergent composition may optionally include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, and hydroxypropyl cellulose. When the concentrate includes an anti-redeposition agent, the anti-redeposition agent can be included in an amount of between approximately 0.5 wt. % and approximately 10 wt. %, and between approximately 1 wt. % and approximately 5 wt. %.

Stabilizing Agents

The solid detergent composition may optionally include stabilizing agents. Examples of suitable stabilizing agents include, but are not limited to: borate, calcium/magnesium ions, propylene glycol, and mixtures thereof. The composition need not include a stabilizing agent, but when the composition includes a stabilizing agent, it can be included in an amount that provides the desired level of stability is the concentrate form of the composition. Exemplary ranges of the stabilizing agent include up to approximately 20 wt. %, between approximately 0.5 wt. % and approximately 15 wt. %, and between approximately 2 wt. % and approximately 10 wt. %.

Dispersants

The solid detergent composition may optionally include dispersants. Examples of suitable dispersants that can be used in the solid detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

The composition may optionally include an enzyme. Exemplary types of enzymes include, but are not limited to lipases, cellulases, proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid detergent composition is provided as a use composition. Exemplary ranges of the enzyme in the concentrate include up to about 15 wt. %, from about 0.5 wt. % to about 10 wt. %, and from about 1 wt. % to about 5 wt. %.

Glass and Metal Corrosion Inhibitors

The solid detergent composition may optionally include a metal corrosion inhibitor in an amount up to about 50 wt. %, from about 1 wt. % to about 40 wt. %, or from about 3 wt. % to about 30 wt. %. The corrosion inhibitor is included in the solid detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the solid detergent composition. The use solution can include from about 6 ppm to about 300 ppm of the corrosion inhibitor, ro from about 20 ppm to about 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate. Again, any oxidative chemistry, such as chlorine derivatives, is preferably segregated from the sugar in the solidification matrix or the solid composition.

Controlling the ratio of the aluminum ion to the zinc ion in the use solution reduces corrosion and/or etching of glassware and ceramics compared with the use of either component alone. In general, the weight ratio of aluminum ion to zinc ion in the use solution can be between at least about 6:1, can be less than about 1:20, and can be between about 2:1 and about 1:15.

An effective amount of an alkaline metal silicate or hydrate thereof can be employed to form a stable solid detergent composition having metal protecting capacity. For example, typical alkali metal silicates are those powdered, particulate or granular silicates which are either anhydrous or preferably which contain water of hydration (about 5% to about 25% by weight, or about 15% to about 20% by weight water of hydration). These silicates are preferably sodium silicates and have an $Na_2O:SiO_2$ratio of about 1:1 to about 1:5, respectively, and typically contain available water in the amount of from about 5% to about 25% by weight. In general, the silicates have an $Na_2O:SiO_2$ratio of about 1:1 to about 1:3.75, about 1:1.5 to about 1:3.75, or about 1:1.5 to about 1:2.5. A silicate with an $Na_2O:SiO_2$ratio of about 1:2 and about 16% to about 22% by weight water of hydration, is most preferred. For example, such silicates are available in powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, an $Na_2O:SiO_2$ ratio of about 1:1.5 to about 1:2.5, have been found to provide the optimum metal protection and rapidly form a solid detergent. Hydrated silicates are preferred.

Silicates can be included in the solid detergent composition to provide for metal protection but are additionally known to provide alkalinity and additionally function as anti-redeposition agents. Exemplary silicates include, but are not limited to sodium silicate and potassium silicate. The solid detergent composition can be provided without silicates, but when silicates are included, they can be included in amounts that provide for desired metal protection. The concentrate can include silicates in amounts of at least about 1 wt. %, at least about 5 wt. %, at least about 10 wt. %, and at least about 15 wt. %. In addition, in order to provide sufficient room for other components in the concentrate, the silicate component can be provided at a level of less than about 35 wt. %, less than about 25 wt. %, less than about 20 wt. %, and less than about 15 wt. %.

Fragrances and Dyes

Various dyes, odorants including perfumes, and other aesthetic enhancing agents may optionally be included in the composition. Suitable dyes that may be included to alter the appearance of the composition, include, but are not limited to Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

Thickeners

The solid detergent compositions may optionally include a rheology modifier or a thickener. The rheology modifier may increase the viscosity of the compositions, increase the particle size of liquid use solutions when dispensed through a spray nozzle, provide the use solutions with vertical cling to surfaces, provide particle suspension within the use solutions, or reduce the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners include, but are not limited to carboxylated vinyl polymers such as polyacrylic acids and sodium salts thereof, ethoxylated cellulose, polyacrylamide thickeners, cross-linked xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to Acusol, available from Rohm & Haas Company, Philadelphia, Pa. and Carbopol, available from B.F. Goodrich, Charlotte, N.C.

Examples of suitable polymeric thickeners also include, but are not limited to polysaccharides. An example of a suitable commercially available polysaccharide includes, but is not limited to, Diutan, available from Kelco Division of Merck, San Diego, Calif. Thickeners for use in the solid detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of xanthomonas campestras. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as $Al^{+3}$, $Fe^{+3}$, $Sb^{+3}$, $Zr^{+4}$ and other transition metals. Examples of suitable commercially available xanthans include, but are not limited to KELTROL™, KELZAN™ AR, KELZANTM™ D35, KELZAN™ S, KELZAN™ XZ, available from the Kelco Division of Merck, San Diego, Calif. Known organic crosslinking agents can also be used. A preferred crosslinked xanthan is KELZAN™ AR, which provides a pseudo plastic use solution that can produce large particle size mist or aerosol when sprayed.

Methods of Making and Using

The disclosed solid detergent compositions are useful in cleaning applications. Such applications includes machine and manual warewashing, pre-soaks, laundry and textile cleaning and destaining, carpet cleaning and destaining, vehicle cleaning and care applications, surface cleaning and destaining, kitchen and bath cleaning and destaining, floor cleaning and destaining, clean-in-place operations, general purpose cleaning and destaining, industrial or household cleaners, and pest control agents.

In general, a solid detergent composition using the solidification matrix of the present disclosure can be created by combining a sugar, a carbonate, water, and any additional functional components and allowing the components to interact and solidify.

In some embodiments, the relative amounts of water and sugar are controlled within a composition. The solidification matrix and additional functional components harden into solid form due to the chemical reaction of the carbonate with the water. The solidification process may last from a few minutes to about six hours, depending on factors including, but not limited to: the size of the formed or cast composition, the ingredients of the composition, and the temperature of the composition.

Solid detergent compositions formed using the solidification matrix are produced using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, pressing, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of this disclosure is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least about 5 seconds. The mixture is then discharged from the mixing system into, or through, a die, a press, or other shaping means. The product is then packaged. In an exemplary embodiment, the formed composition begins to harden to a solid form in about 1 minute to about 3 hours, about 1 minute to about 2 hours, or about 1 minute to about 20 minutes.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least about 60 seconds. Once the mixing is complete, the product is transferred to a packaging container where solidification takes place. In an exemplary embodiment, the cast composition begins to harden to a solid form in about 1 minute to about 3 hours, about 1 minute to about 2 hours, or about 1 minute to about 20 minutes.

The term "solid block form" means that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to about 100° F. and particularly greater than about 120° F.

The resulting solid detergent composition may take forms including, but not limited to a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between about 50 grams and about 250 grams, extruded solids formed by the solidification matrix have a weight of about 100 grams or greater, and solid block detergents formed by the solidification matrix have a mass of between about 1 and about 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, a tablet, or packaged powder having a size from about 1 gram to about 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of from about 5 grams to about 10 kilograms. In certain embodiments, a multiple-use form of the solid detergent composition has a mass from about 1 kilogram to about 10 kilograms, from about 5 kilograms to about approximately 8 kilograms, from about 5 grams to about 1 kilogram, or from about 5 grams to about 500 grams.

Although the detergent composition is discussed as being formed into a solid product, the detergent composition may also be provided in the form of a paste. When the concentrate is provided in the form of a paste, enough water is added to the detergent composition such that complete solidification of the detergent composition is precluded. In addition, dispersants and other components may be incorporated into the detergent composition in order to maintain a desired distribution of components.

EXAMPLES

Example 1

Block Stability

Example 1 determined the stability and swelling of several compositions shown in Table 1.

TABLE 1

| Sugar Compositions | | | | | | | |
|---|---|---|---|---|---|---|---|
| | Formula 1 | Formula 2 | Formula 3 | Formula 4 | Formula 5 | Formula 6 | Formula 7 |
| **Solids Premix** | | | | | | | |
| dense ash | 78.81 | 78.81 | 78.81 | 78.81 | 78.81 | 78.81 | 78.81 |
| fructo-oligo-saccharides from chicory | | 3.00 | | | | | |
| potato starch | | | 3.00 | | | | |
| N-acetyl-D-glucosamine | | | | 3.00 | | | |
| xylitol | | | | | 3.00 | | |
| gluconic acid (50%) | | | | | | 6.00 | |
| glucopon 225 | | | | | | | 3.00 |
| sodium sulfate | 4.50 | 1.50 | 1.50 | 1.50 | 1.50 | | 1.50 |
| **Surfactant Premix** | | | | | | | |
| fatty alcohol 3EO, 6PO (Dehypon LS-36) | 2.00 | 2.00 | 2.00 | 2.00 | 2.00 | 2.00 | 2.00 |
| **Liquid Premix** | | | | | | | |
| polyacrylic acid sodium salt (45%) (Acusol 445N) | 6.52 | 6.52 | 6.52 | 6.52 | 6.52 | 6.52 | 6.52 |
| polyacrylic/polymaleic acid block copolymer (46%) (Acusol 448) | 6.67 | 6.67 | 6.67 | 6.67 | 6.67 | 6.67 | 6.67 |
| water | 1.50 | 1.50 | 1.50 | 1.50 | 1.50 | | 1.50 |

The premixes were assembled. Then the solid premix and the surfactant premix were combined together until homogeneous. The liquid premix was then added to the combined solid and surfactant premixes and mixed until homogeneous. After the compositions were mixed, 50 grams of each composition were poured into a 44.4 mm circular die. Once in the die, the compositions were pressed at 1000 psi for 20 seconds. After being pressed, the diameter and thickness of the composition were measured. Tablets were stored at 122° F. for a period of either 1 day or 4 days. After this storage time elapsed, tablets were removed from storage and the diameter and thickness of each tablet were measured. The resulting percent swelling for each tablet is shown in Table 2.

TABLE 2

| Stability Results of the Compositions from Table 1 | | | | |
|---|---|---|---|---|
| Formula | Percent change in Diameter | Percent change in Thickness | Average percent change | Storage Time |
| 1 | 8.10 | 7.19 | 7.65 | 4 days |
| 2 | 5.31 | 5.42 | 5.37 | 4 days |
| 3 | 12.71 | 14.83 | 13.77 | 4 days |
| 4 | 9.73 | 12.43 | 11.08 | 4 days |
| 5 | 2.98 | 4.11 | 3.54 | 1 day |
| 6 | 1.45 | 2.82 | 2.14 | 1 day |
| 7 | 9.64 | 6.85 | 8.24 | 1 day |

Table 2 shows that for a storage period at 122° F., most tablets swelled within four days and some within 24 hours of storage with a growth exponential of at least 3 percent. This is considered to be an unacceptable growth exponential and therefore the sugars associated with these formulas will not prevent a carbonate hydrate solid from swelling.

Example 2

Sugar Alcohol Block Stability

Example 2 compared the stability of a 6 carbon sugar alcohol and a 3 carbon sugar alcohol. The compositions are shown in Table 3.

TABLE 3

| Sugar Alcohol Compositions | | | |
|---|---|---|---|
| Material | Control | Sugar Alcohol (6C) | Sugar Alcohol (3C) |
| solids premix | | | |
| dense ash | 84.81 | 81.81 | 81.81 |
| sorbitol | | 3.00 | |
| glycerine | | | 3.00 |
| liquid premix | | | |
| polyacrylic acid sodium salt (45%) (Acusol 445N) | 6.67 | 6.67 | 6.67 |
| polyacrylic/polymaleic acid block copolymer (46%) (Acusol 448) | 6.52 | 6.52 | 6.52 |
| surfactant premix | | | |
| Fatty alcohol 3EO, 6PO (Dehypon LS-36) | 2.00 | 2.00 | 2.00 |

The premixes were individually assembled. Then the solid and surfactant premixes were combined and mixed until homogeneous. The liquid premix was then added and mixed until homogeneous. Once mixed, 50 grams of the composition was poured into a 44.4 mm circular die. Once in the die, the tablets were pressed at 1000 psi for 20 seconds. After being pressed, the diameter and thickness of the tablets were measured. The tablets were then stored in temperatures of 122° F. After 24 hours, the diameter and thickness were measured again. The tablets were then stored at 122° F. for one week. After one week, the diameter and thickness were measured again using digital calipers supplied by VWR. The results are shown in Table 4.

TABLE 4

| Stability Results of the Compositions from Table 3 | | | | | | |
|---|---|---|---|---|---|---|
| Formula | Percent change in diameter - 24 hrs | Percent change in thickness - 24 hrs | Average percent change - 24 hrs | Percent change in diameter - 1 week | Percent change in thickness - 1 week | Average percent change - 1 week |
| 6 C Sugar Alcohol | 0.36 | 1.02 | 0.69 | 0.71 | 1.60 | 1.15 |
| 3 C Sugar Alcohol | 3.02 | 2.35 | 2.68 | 5.97 | 7.15 | 6.56 |
| Control | 0.96 | 1.78 | 1.37 | 1.75 | 5.54 | 3.65 |

Table 4 shows that after a period of 24 hours, no tablet had swollen to a growth exponential of 3 percent, however after 1 week, both the control formula and the 3C sugar alcohol formula had both swollen to a growth exponential of greater than 3. This proves that a tablet made without a sugar will swell as well as a tablet made with a sugar alcohol of only 3 carbons. This also shows that a tablet made with a 6 C sugar alcohol will not swell after 1 week at 122° F.

Example 3

Stability of a Solid Block With and Without Sucrose

Example 3 compared the stability of a block with and without sucrose. Table 5 shows the formulas for the control composition (no sucrose) and the sucrose composition.

TABLE 5

| Sucrose and Control Formulas | | |
|---|---|---|
| Material | Control | Sucrose |
| Solid Premix | | |
| dense sodium carbonate | 79.63 | 76.93 |
| sucrose | 0.00 | 3.00 |
| Surfactant Premix | | |
| Fatty alcohol 3EO, 6PO (Dehypon LS-36) | 1.54 | 1.54 |
| polyoxyethylene Block copolymer (Plurafac 25R2) | 0.46 | 0.46 |
| Liquids Premix | | |
| soft water | 5.18 | 4.88 |
| polyacrylic acid sodium salt (45%) (Acusol 445N) | 6.67 | 6.67 |
| polyacrylic/polymaleic acid block copolymer (46%) (Acusol 448) | 6.52 | 6.52 |

The premixes were individually assembled. Then the solid and surfactant premixes were combined and mixed until homogeneous. The liquid premix was then added and mixed until homogeneous. Once mixed, 50 grams of the composition was poured into a 44.4 mm circular die. Once in the die, the compositions were pressed at 1000 psi for 20 seconds for a total of three tablets for each formula. After being pressed, the diameter and thickness of each tablet were measured. One tablet was stored at each temperature of ambient, 100° F. and 122° F. After 24 hours, the diameter and thickness were measured again using digital calipers supplied by VWR. The results are shown in Table 6.

TABLE 6

| Stability Results of the Compositions in Table 5 After 24 Hours | | | | | | |
|---|---|---|---|---|---|---|
| | Control Formula | | | With 3% Sucrose | | |
| Storage Temp | Percent change in diameter | Percent change in thickness | Average percent change | Percent change in diameter | Percent change in thickness | Average percent change |
| ambient | 0.35 | 0.47 | 0.41 | −0.55 | 1.05 | 0.25 |
| 100° F. | 0.59 | −0.19 | 0.20 | −0.56 | 1.20 | 0.32 |
| 122° F. | 2.52 | 3.49 | 3.00 | 0.65 | 0.85 | 0.75 |

These results show that after a period of 24 hours at 122° F., a formula made without sugar will swell compared to a tablet made with sucrose in the formula. Table 6 also shows that at ambient temperatures, the rate of swelling is slow and the tablets may even shrink as evidenced by the negative growth shown in Table 6.

The above specification, examples and data provide a complete description of the manufacture and use of the composition of the disclosure. Since many embodiments of the disclosure can be made without departing from the spirit and scope of the disclosure, the invention resides in the claims.

We claim:

1. A method of solidifying a composition, the method comprising:

(a) mixing a solidification matrix consisting of:

i) 0.25-10 wt % of a sugar selected from the group consisting of a monosaccharide, a disaccharide, a sugar alcohol having at least 6 carbon atoms, and mixtures thereof;

ii) a carbonate; and iii) water, wherein the sugar is present in the solidification matrix in an amount of at least 0.001 parts for every 4 parts water; and (b) adding the solidification matrix to a composition consisting of a surfactant, optionally water, and one or more additional functional materials selected from the group consisting of sequestrant, builder, water conditioner, bleaching agent, filler, defoaming agent, anti-redeposition agent, stabilizing agent, dispersant, enzyme, corrosion inhibitor, fragrance, dye, thickener, and mixtures thereof to form a solidified material;

wherein:

carbonate is present in the solidified material at about 60-90 wt-% and phosphorus is present in the solidified material at less than about 5 wt-%; and if subjected to a temperature of 120° F., the composition is dimensionally stable and has a growth exponent of less than about 3%.

2. The method of claim 1, further comprising casting the material into a packaging container.

3. The method of claim 1, further comprising forming the material into a paste.

4. The method of claim 1, further comprising forming the material into a block.

5. The method of claim 1, wherein the composition solidifies within 1 minute to about 2 hours.

6. The method of claim 1, wherein phosphorus is present in the solidified material at less than about 0.5 wt-%.

7. The method of claim 1, wherein the composition is substantially free of phosphorus.

8. The method of claim 1, wherein the composition is free of an alkaline source other than carbonate.

9. The method of claim 1, wherein one of the additional functional materials is a sequestrant.

* * * * *